US008578835B2

(12) United States Patent
Chiappini et al.

(10) Patent No.: US 8,578,835 B2
(45) Date of Patent: Nov. 12, 2013

(54) STORAGE SYSTEM FOR ARTILLERY AMMUNITION AND ASSOCIATED COMPUTER PROGRAM

(75) Inventors: Andrea Chiappini, La Spezia (IT); Andrea Bruschi, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 58 days.

(21) Appl. No.: 13/155,146

(22) Filed: Jun. 7, 2011

(65) Prior Publication Data

US 2012/0024144 A1 Feb. 2, 2012

(30) Foreign Application Priority Data

Jun. 8, 2010 (IT) ..... TO2010A0482

(51) Int. Cl.
*F41A 9/00* (2006.01)

(52) U.S. Cl.
USPC ..... 89/46; 89/45; 89/47

(58) Field of Classification Search
USPC ..... 89/45–47
See application file for complete search history.

(56) References Cited

U.S. PATENT DOCUMENTS 2,745,317 A * 5/1956 Stanton et al. ..... 89/46
3,218,930 A * 11/1965 Girouard et al. ..... 89/45
4,457,209 A * 7/1984 Scheurich et al. ..... 89/45
4,495,853 A * 1/1985 Gottwaldt ..... 89/46
4,947,728 A * 8/1990 Muhlhausen et al. ..... 89/46
4,966,064 A 10/1990 Kaustrater et al.

FOREIGN PATENT DOCUMENTS

EP 0 277 478 8/1988
WO WO 84/00416 2/1984

OTHER PUBLICATIONS

Italian Search Report for Application No. TO20100482 mailed 26 Jan. 2011.

* cited by examiner

*Primary Examiner* — Samir Abdosh
(74) *Attorney, Agent, or Firm* — Merchant & Gould P.C.

(57) ABSTRACT

A storage system (10) for artillery ammunition, capable of containing artillery ammunition (100) of various types and comprising a plurality of drums (11) rotating about a central axis (Y) of their own and having a plurality of cells (11*a*), each adapted to contain one of the ammunition (100). The storage system (10) includes a rotatable support (12), which can turn about an axis of rotation (Z) of its own, parallel to the central axis (Y), on which the plurality of rotary drums (11) are rotatably pivoted. The system further includes at least one data processing unit for the automated selection of a drum (11') from among the plurality of rotary drums (11).

7 Claims, 5 Drawing Sheets

STORAGE SYSTEM FOR ARTILLERY AMMUNITION AND ASSOCIATED COMPUTER PROGRAM

This application claims benefit of Serial No. TO 2010 A 000482, filed 8 Jun. 2010 in Italy and which application is incorporated herein by reference. To the extent appropriate, a claim of priority is made to the above disclosed application.

BACKGROUND OF THE INVENTION

The present invention relates to the field of devices adapted to assist in loading artillery ammunition; more in detail, it relates to a storage system for artillery ammunition and to an associated computer program.

It is known that on warships and submarines artillery ammunitions are stored in magazines which are typically located below deck or on a deck typically positioned near the ship's bottom.

The artillery ammunition must be picked from the magazine and transported to the piece of artillery, where they can then be fired.

One problem which is encountered when handling artillery ammunition is caused by the weight and dimensions thereof. In fact, such ammunition may weigh up to several hundreds of kilograms, which makes them essentially impossible to manipulate by hand, thus requiring the use of special handling devices.

Moreover, the pieces of artillery carried by ships and submarines can traditionally fire munitions of different types, characterized by different calibre, length, explosive power and warhead type. Therefore, there is a need for having available, on the ship's deck used as an ammunition magazine, devices or systems capable of handling munitions of different natures.

Although known magazines can contain ammunition of different types, they however suffer from some limitations. When a firing action is taking place, especially a fast one, as is typical, for example, in the course of a battle, the munitions are moved from the magazine to a hoist and then up to a piece of artillery in a not wholly automatic manner, and when the type of ammunition must be changed a manual action is still required.

Furthermore, if a munition is not fired, traditional storage systems will not allow it to be automatically unloaded.

The storage systems known in the art usually include structures, called drums, in which the artillery ammunition are inserted, ready for being sent to a piece of artillery. The artillery ammunition drum resembles, as far as its function is concerned, a larger-scale copy of a typical drum of a revolver pistol, and operates in a similar manner, although artillery ammunition are not fired directly from the drum, being only picked up therefrom, one piece at a time, following one rotation thereof.

The storage systems known in the art do not allow the drum to be partially loaded with ammunition during a firing action. When the drum is empty, the firing action must be interrupted and the drum must be loaded again. During both offensive and defensive firing actions, this turns out to be particularly dangerous because the warship or submarine is substantially placed in the condition of not being able to fire and of needing to replace the piece of artillery for which ammunition is about to be loaded onto the drum with other pieces of artillery which, due to their different firing power or position on the ship or submarine, might be inefficient or even incapable of hitting the target(s) (e.g. because they are being covered by the foredeck or by the tower).

SUMMARY OF THE INVENTION

It is therefore a first object of the present invention to describe a storage system for artillery ammunition which is free from the above-mentioned drawbacks.

It is a second object of the present invention to describe a computer program which allows for the automatic selection of one drum from among a plurality of drums in a storage system for artillery ammunition.

The present invention provides a computer program which can be loaded into the memory of at least one electronic computer and which is susceptible of automatically selecting one piece of artillery ammunition in a storage system for artillery ammunition.

BRIEF DESCRIPTION OF THE DRAWINGS

The invention will now be described with reference to the annexed drawings, which illustrate one non-limiting embodiment thereof, wherein.

DETAILED DESCRIPTION

Figure 1:
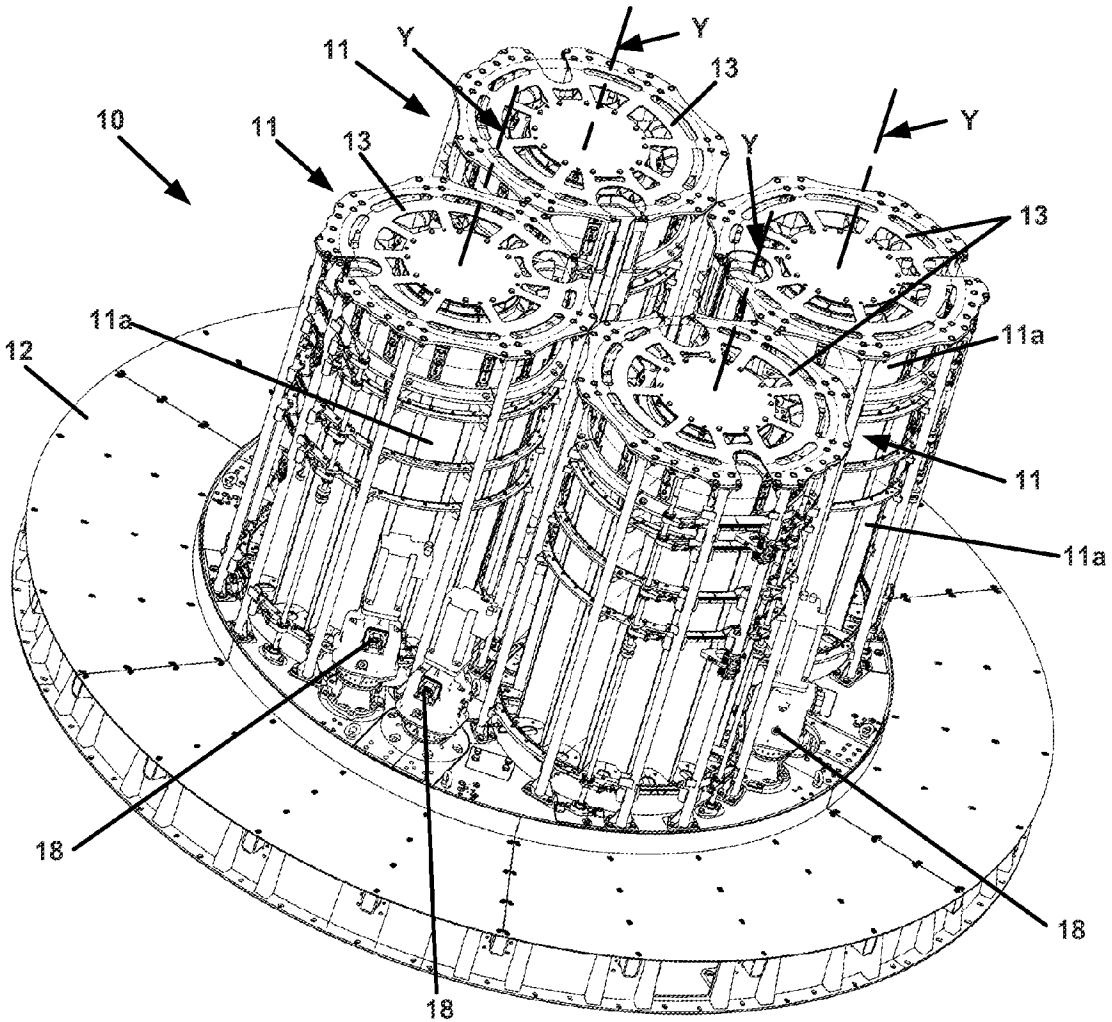
FIG. 1 is a first perspective view of a storage system for artillery ammunition according to the present invention.
Figure 2:
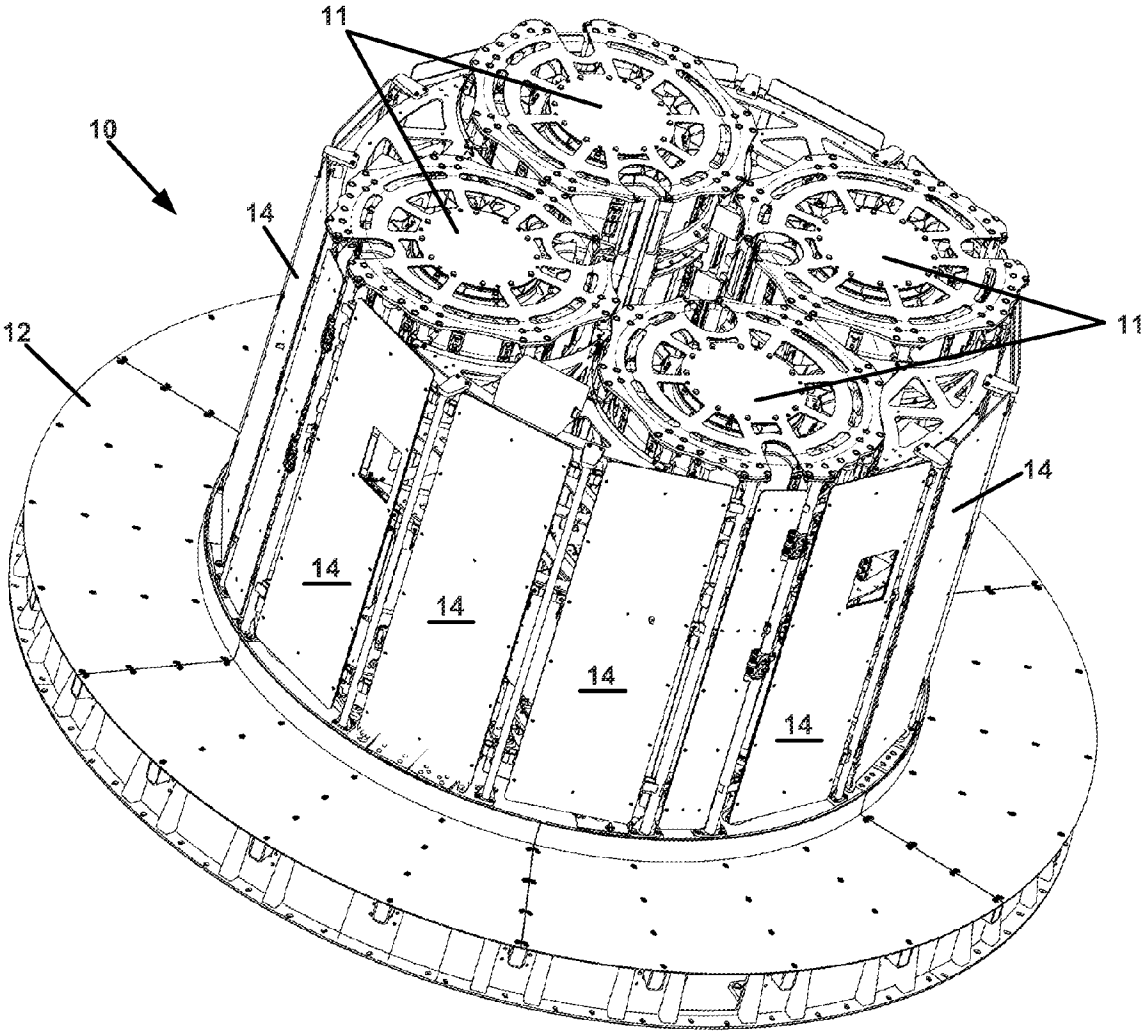
FIG. 2 is a second perspective view of a storage system for artillery ammunition according to the present invention.

Referring now to FIGS. 1 and 2, reference numeral 10 designates as a whole a storage system for artillery ammunition.

System 10 comprises:

- a plurality of rotary drums 11, which rotate about a respective first axis Y (or central axis); and
- a rotatable support 12, which can turn about a second axis Z, parallel to the axis Y, and on which the plurality of rotary drums 10 are rotatably pivoted; and
- a data processing unit 30 for the automated selection of drum 10, which can also rotate rotatable support 12 in order to change the drum from which munition 100 is to be picked up in order to be sent to the piece of artillery on a conveying device.

More in detail, each rotary drum 11 comprises a plurality of cells 11*a* designed to contain a respective munition 100 arranged substantially parallel to axis Y. In particular, cells 11*a* can contain traditional artillery ammunition, HEFSDS (High-Explosive Fin-Stabilized Discarding Sabot) ammunition, or APFSDS (Armour-Piercing Fin-Stabilized Discarding Sabot) ammunition.

As shown in FIG. 2, all around drums 11 a plurality of panels 14 extend, which are substantially arranged parallel to axis Z, and which form as a whole a cylinder adapted to contain drums 11 and having a smaller diameter than said rotatable support 12.

Each one of drums 11, which is turned about the respective first axis Y by a respective motor 18 arranged at the base, in the lower area in contact with rotatable support 12, comprises a plurality of cells 11*a*, each of which contains one munition 100; all the cells of a drum 11 are designed to contain the same type of munition 100, so that on rotatable support 12 there may coexist, for example, a first drum 11 with cells 11*a* susceptible of containing ammunition of a first type, and a second drum 11 with cells 11*a* susceptible of containing ammunition of a second type, different from the first one. Thus, rotatable support 12 acts as if it were a drum itself, equipped with sub-elements (actual drums 11).

Cells 11*a* are oriented substantially parallel to axis Y, and therefore have a direction of maximum extension which is parallel to this latter axis. Once munitions 100 have been loaded into the respective cells 10*a*, they are also substantially oriented like axis Y.

Figure 6:
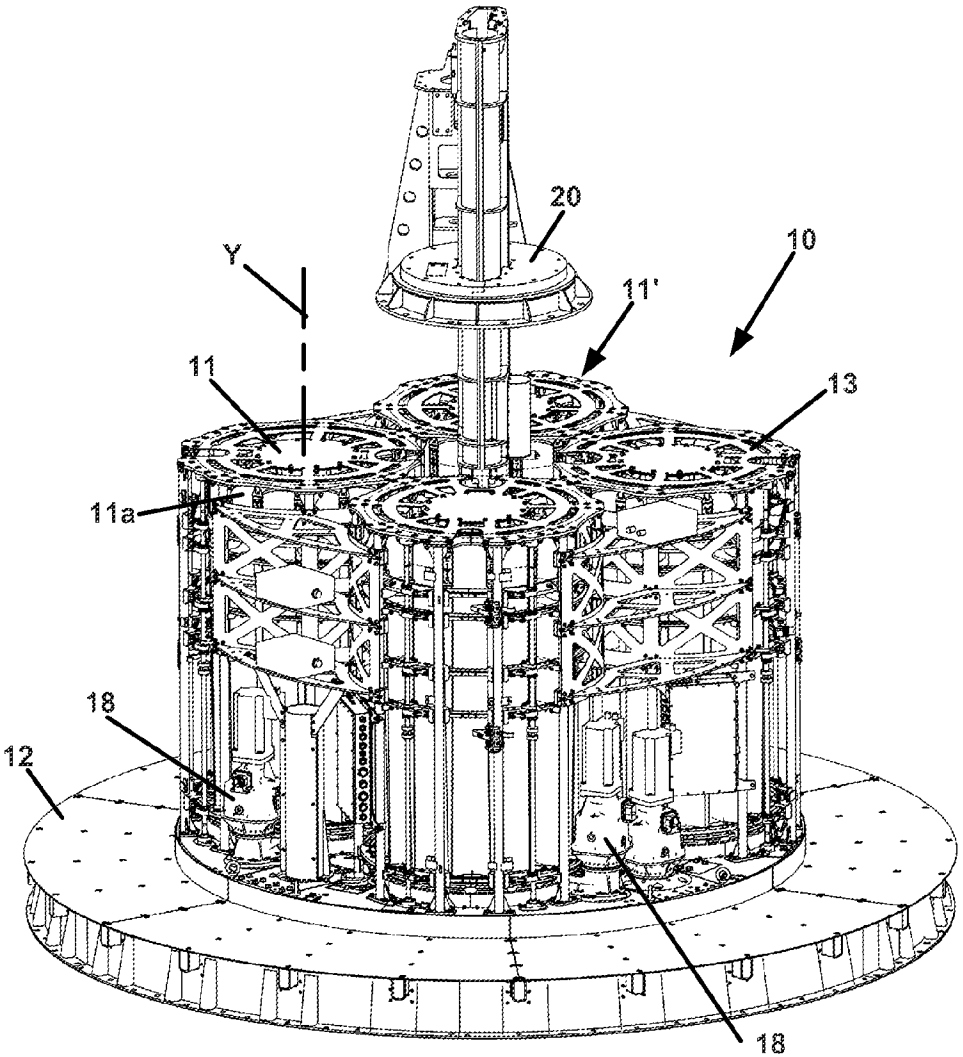
FIG. 6 is a third perspective view of a storage system for artillery ammunition according to the present invention, inclusive of an ammunition hoist.

Finally, FIG. 6 shows that storage system 10 according to the present invention further comprises extraction and loading means 20, which pick up munitions 100 in a known manner from a drum 11' selected from among the plurality of drums 11 on rotatable support 12, and extract munition 100 from one of cells 11*a* in order to place it into an ammunition hoist that will carry it to the piece of artillery. In particular, drum 11' is selected by rotating rotatable support 12.

The ammunition extraction and loading means 20 are also configured in a manner such as to be able to unload munition 100 from the hoist and reposition it into respective cell 11*a* on selected drum 11' if it has not been fired.

Figure 4:
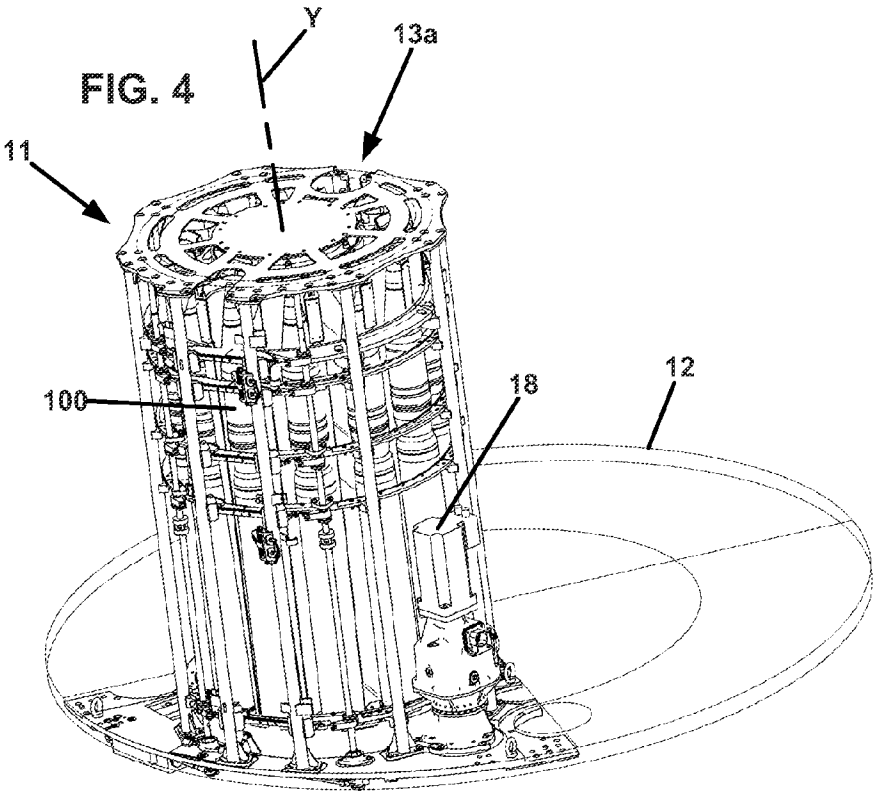
FIGS. 3, 4 and 5 respectively show some parts of the storage system for artillery ammunition of FIG. 1.
Figure 3:
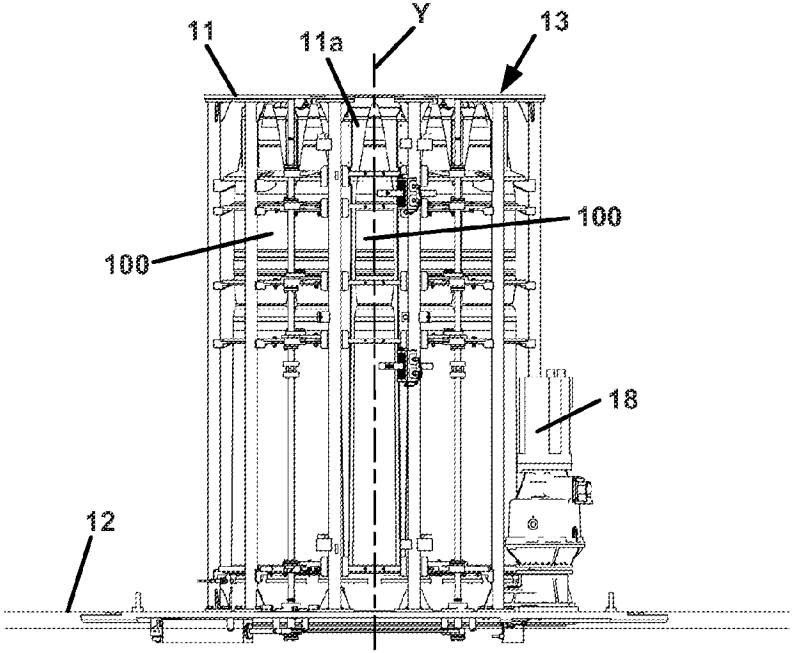
Figure 5:
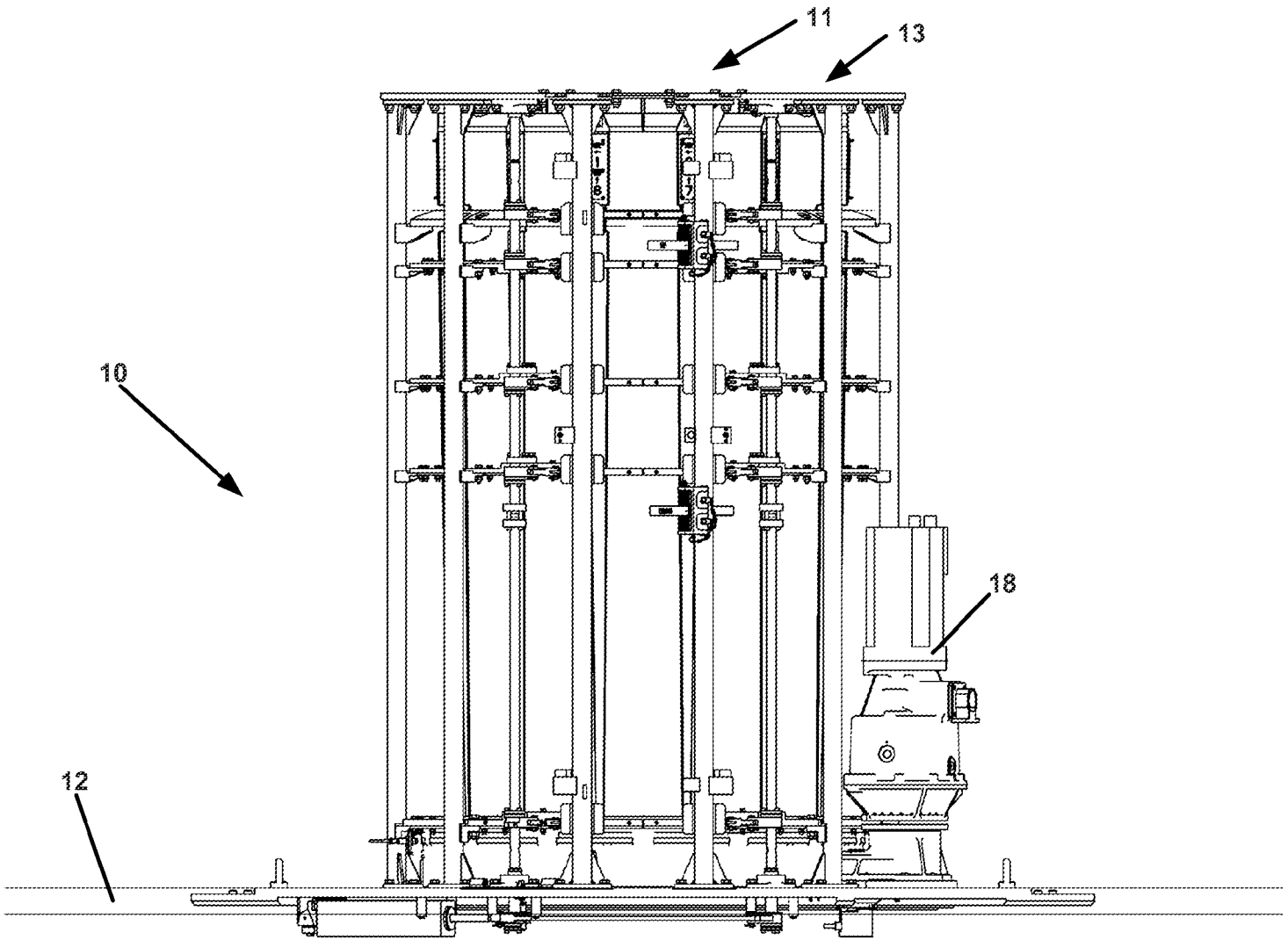

As shown more in detail in FIGS. 3-5, each one of drums 11 further comprises a rack 13 having a substantially circular cross-section and being so positioned around the drum body as to inscribe it within itself.

In fact, each cell 11*a* is concave towards the outside of drum 11 and delimits the position of the munition towards the centre of drum 11. Therefore, each cell 11*a* substantially describes a first semicylinder that contains one munition 100, which is coupled to the circumference of rack 13 in a manner such that munition 100 touches rack 13 tangentially. Rack 13 delimits the position of the munition itself on the external area of the drum.

Rack 13, which has an axis coinciding with axis Y of drum 11 and is rotatable relative to the latter, is not completely closed, but has an opening 13*a*, the size of which allows for the insertion of one munition 100; through this opening, munitions 100 can be loaded into drum 11 one at a time.

Therefore, thanks to opening 13 it is possible to reload drums 11 other than selected drum 11' by placing thereinto one munition at a time by means of one rotation of rack 13 relative to drum 11.

In addition, the storage system for artillery munitions according to the present invention also comprises a data processing unit capable of selecting, upon a user's command, one specific type of ammunition 100 and, as a result, one specific drum 11 from among the plurality of drums 11 installed on rotatable support 12.

The data processing unit 30 reads a memory or data storage device containing ammunition-drum associations, thus substantially storing the positions of each specific type of ammunition available on rotatable support 12.

When a particular type of ammunition 11 (s-type ammunition, for simplicity) is selected, data processing unit 30 sends rotation control signals to an actuator of rotatable support 12 in order to allow drum 11 containing ammunition of the specified type (s-type ammunition) to be positioned at a point corresponding to the extraction and loading means 20; at this point, it controls respective motor 18 for rotating the drum, following the loading of a munition 100, towards the piece of artillery.

In the meantime, all the drums of a type different from those of the selected type can be reloaded by placing one munition at a time into opening 13*a* of rack 13.

If a different type of ammunition is to be used, the user must operate the data processing unit by selecting a second type of ammunition (t-type ammunition); once again, the data processing unit will send rotation control signals to an actuator of rotatable support 12 in order to allow drum 11 containing ammunition of the specified type (t-type ammunition) to be positioned at a point corresponding to the extraction and loading means 20; in this case, the drum containing the s-type ammunition will no longer be near the extraction and loading means and, as a result, it can be loaded again as previously described.

The advantages of the storage system for artillery ammunition according to the present invention are apparent in the light of the above description. In particular, it allows feeding different types of ammunition from the magazine to a hoist and then up to a piece of artillery in the course of a firing action, even a fast one, in a completely automated manner. In particular, through the storage system for artillery munitions according to the present invention it is possible to provide an artillery ammunition supply at a rate higher than thirty rounds per minute.

Furthermore, if a munition has not been fired, then the storage system according to the present invention allows it to be automatically unloaded again (the so-called strike down) towards the cell of the respective drum.

The storage system for artillery ammunition according to the present invention also allows reloading the ammunition drums in the course of a firing action. This possibility is very advantageous during both offensive and defensive firing actions, in that it avoids or anyway considerably reduces the risk that the warship or submarine might be unable to fire, thus preventing the latter from having to replace the piece of artillery whose munitions are about to be reloaded into the drum with other pieces of artillery which, due to their different firing power or position on the ship's or submarine's body, might be inefficient or even incapable of hitting the target(s) (e.g. because they are being covered by the foredeck or by the tower).

Furthermore, the system according to the present invention is modular and disassemblable, and can therefore be easily taken aboard.

Finally, the drums of the system according to the present invention can be arranged close to one another until the racks substantially touch; this ensures substantially smaller overall dimensions.

The device described so far may be subject to variations, modification or additions obvious to the man skilled in the art without departing from the protection scope thereof as set out in the appended claims.

The invention claimed is:

1. A storage system for artillery ammunition, capable of containing artillery ammunition of various types and comprising a plurality of drums rotating about a central axis, each of the drums having a plurality of cells, each of the cells being adapted to contain one of said ammunition; said storage system comprising:

a rotatable support, which can turn about an axis of rotation, parallel to said central axis, on which said plurality of rotary drums are rotatably pivoted; and at least one data processing unit for automated selection of a drum from among said plurality of drums;

wherein each drum of said plurality of drums comprises an external rack positioned around each drum of said plurality of drums, wherein each cell comprises a semi-cylindrical structure for containing the ammunition, the semi-cylindrical structure being concave and delimits a position of said ammunition in the respective cell towards a center of said drum, and wherein said external rack delimits said position of said ammunition in the cell on an external area of said drum;

wherein said external rack is rotatably mounted with respect to said drum and comprises an opening for inserting ammunition into said cell; said opening extending, for a maximum dimension thereof, parallel to said central axis.

2. The storage system for artillery ammunition according to claim 1, wherein said plurality of drums comprise at least one first drum capable of being turned by a respective motor and including a plurality of cells designed to contain a first type of artillery ammunition, and one second drum including a plurality of cells designed to contain a second type of artillery ammunition.

3. The storage system for artillery ammunition according to claim 1, wherein said cells have a direction of maximum extension substantially parallel to said central axis and are consequently capable of containing artillery ammunition substantially oriented parallel to said central axis.

4. The storage system for artillery ammunition according to claim 1, further comprising means for extracting said artillery ammunition from a cell of a drum selected from among said plurality of drums and for loading said artillery ammunition onto an ammunition hoist.

5. The storage system for artillery ammunition according to claim 4, wherein said extraction and loading means are configured in a manner to allow ammunition that has not been fired to be unloaded and placed back into the respective cell.

6. The storage system for artillery ammunition according to claim 1, wherein said opening enables loading of said artillery ammunition into said cell in an operating condition in which a piece of artillery is firing artillery ammunition loaded from a drum selected from among said plurality of drums different from said drum for which said artillery ammunition is being loaded into said cell.

7. The storage system for artillery ammunition according to claim 1, wherein said drums are configured for housing naval artillery cannon or howitzer munitions of the HEFSDS (High-Explosive Fin-Stabilized Discarding Sabot) type or of the APFSDS (Armour-Piercing Fin-Stabilized Discarding Sabot) type.

* * * * *